US010408466B2

(12) United States Patent
Bayerlein et al.

(10) Patent No.: US 10,408,466 B2
(45) Date of Patent: Sep. 10, 2019

(54) COOKING HOB FRAME

(71) Applicant: Electrolux Home Products, Inc., Charlotte, NC (US)

(72) Inventors: Stefan Bayerlein, Feuchtwangen (DE); Stefan Dänzer, Wettringen (DE)

(73) Assignee: Electrolux Home Products, Inc., Charlotte, NC (US)

( * ) Notice: Subject to any disclaimer, the term of this patent is extended or adjusted under 35 U.S.C. 154(b) by 464 days.

(21) Appl. No.: 15/096,208

(22) Filed: Apr. 11, 2016

(65) Prior Publication Data

US 2017/0292714 A1 Oct. 12, 2017

(51) Int. Cl.
*F24C 15/10* (2006.01)
*F24C 15/08* (2006.01)

(52) U.S. Cl.
CPC ..... *F24C 15/108* (2013.01); *F24C 15/08* (2013.01); *F24C 15/10* (2013.01)

(58) Field of Classification Search
CPC ..... F24C 15/108; F24C 15/08; F24C 15/10
See application file for complete search history.

(56) References Cited

U.S. PATENT DOCUMENTS 3,347,609 A * 10/1967 Mann ..... A47B 47/03 126/191
5,571,434 A * 11/1996 Cavener ..... F24C 15/102 219/452.12
2007/0044788 A1 3/2007 Jacobs
2007/0169770 A1 7/2007 Kuwamura
2013/0327315 A1* 12/2013 Sosso ..... F24C 15/20 126/39 E
2014/0263276 A1 9/2014 Harward

FOREIGN PATENT DOCUMENTS

DE 3404199 * 8/1985

OTHER PUBLICATIONS

Translation of DE3404199, Inventor: Schnabel, Title: "Baking Oven", Pub. Date: Aug. 8, 1985.*

* cited by examiner

*Primary Examiner* — Alfred Basichas
(74) *Attorney, Agent, or Firm* — Pearne & Gordon LLP

(57) ABSTRACT

A frame is provided for supporting a hob plate of a hob. The frame includes a frame body and at least one mounting tongue depending from the frame body and extending from an underside thereof for connecting the frame to a chassis of a cooking appliance.

27 Claims, 5 Drawing Sheets

COOKING HOB FRAME

FIELD

The present invention relates generally to a frame, and, more particularly, to a frame for mounting a hob plate of a hob to a chassis of a cooking appliance.

BACKGROUND

Cooking appliances can include a hob that can be mounted to a chassis. When installing the hob on the chassis, separate trims and brackets are used to connect the hob to the chassis. Such trims and brackets increase the part count and costs of a cooking appliance, as well as increase the efforts needed to assemble or disassemble the appliance. Moreover, such trims and brackets often do not contribute to the mechanical strength of the appliance.

SUMMARY

In accordance with a first aspect, a frame is provided for supporting a hob plate of a hob. The includes a frame body and at least one mounting tongue depending from the frame body and extending from an underside thereof for connecting the frame to a chassis of a cooking appliance.

In accordance with a second aspect, a frame is provided for supporting a hob plate of a hob. The frame includes a frame body and an embossment depending from the frame body and extending from an underside of the frame body for spacing the frame body from a chassis of a cooking appliance when the frame body is connected to the chassis.

In accordance with a third aspect, a cooking appliance includes a chassis and a hob having a hob plate and a frame mounted to the chassis and supporting the hob plate. The frame includes a frame body and at least one mounting tongue depending from the frame body and extending from an underside of the frame body, the at least one mounting tongue connecting the frame body to the chassis.

BRIEF DESCRIPTION OF THE DRAWINGS

The foregoing and other aspects will become apparent to those skilled in the art to which the present examples relate upon reading the following description with reference to the accompanying drawings, in which.

DETAILED DESCRIPTION

Figure 1:
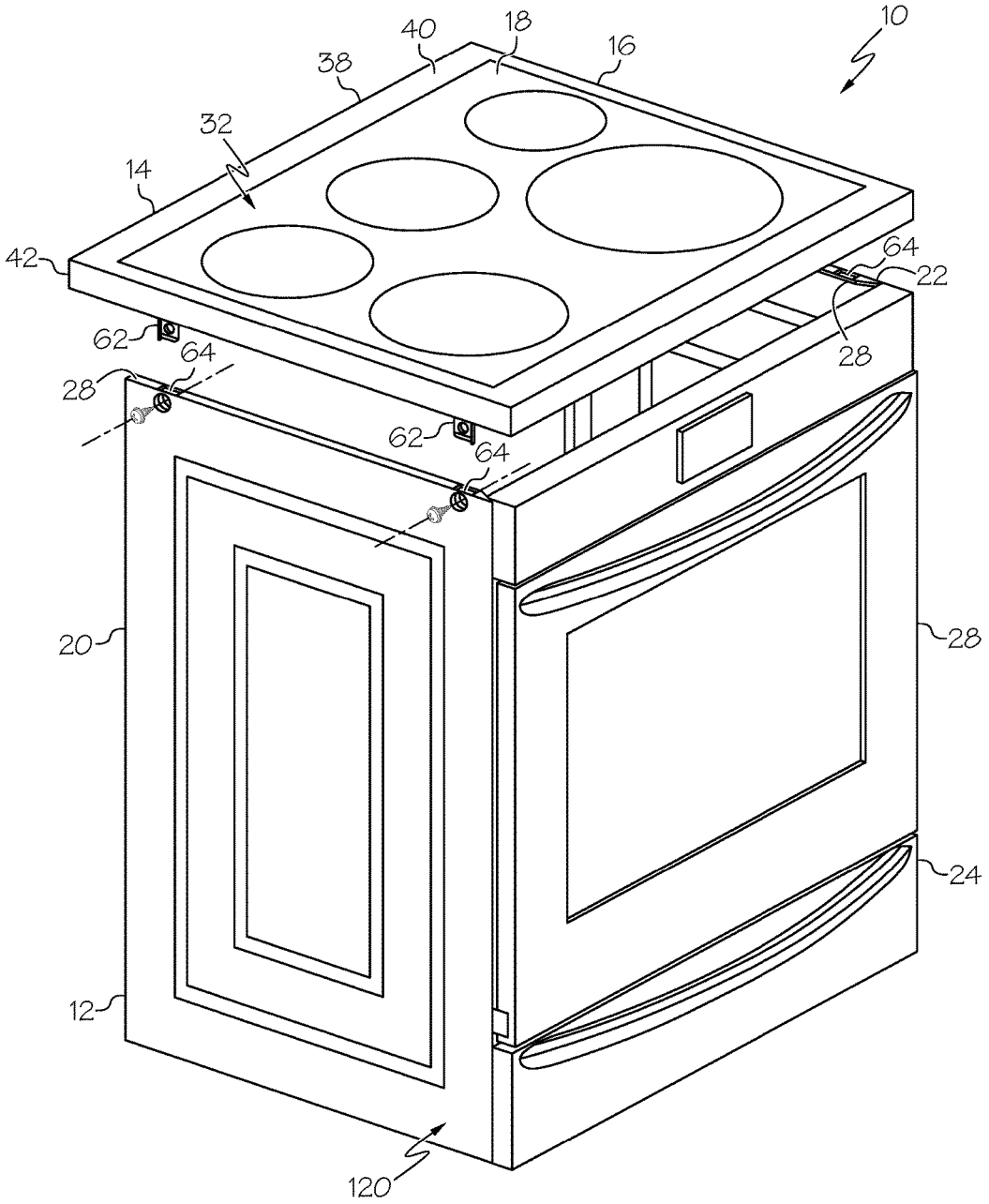
FIG. 1 is a perspective view of an example cooking appliance with the hob separated from the chassis.
Figure 3:
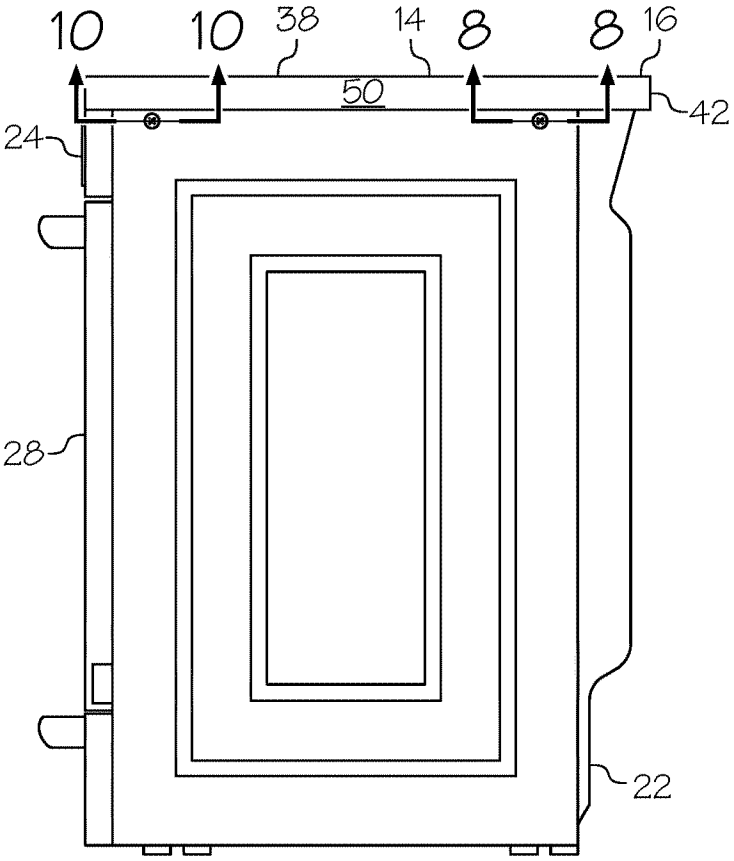
FIG. 3 is a right side view of the cooking appliance.
Figure 2:
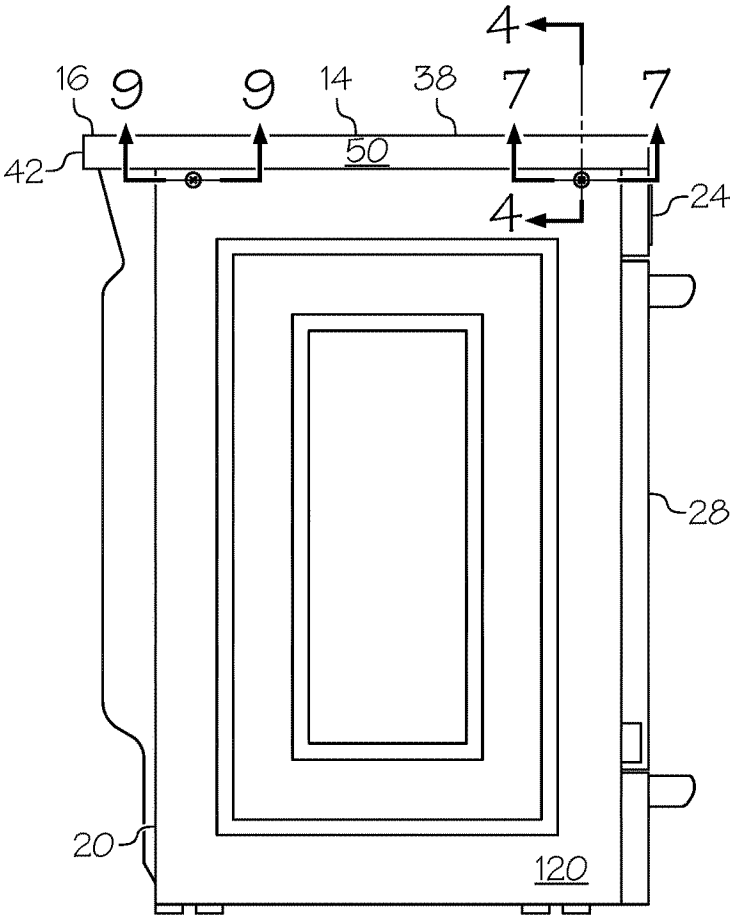
FIG. 2 is a left side view of the cooking appliance.

An example cooking appliance 10 is shown in FIGS. 1-3. The appliance includes a chassis 12 and a hob 14 that can be mounted to the chassis 12. The hob 14 includes a frame 16 and a hob plate 18. The chassis 12 includes a pair of side panels 20, 22 and a front panel 24. The front panel 24 can include or accommodate a door 26 for providing selective access to an oven compartment within the chassis 12. Meanwhile, each of the side panels 20, 22 can include a mounting portion or flange 28 that extends horizontally inward from the side panel that, as discussed in further detail below, can be used for mounting the hob 14 to the chassis 12.

Figure 4:
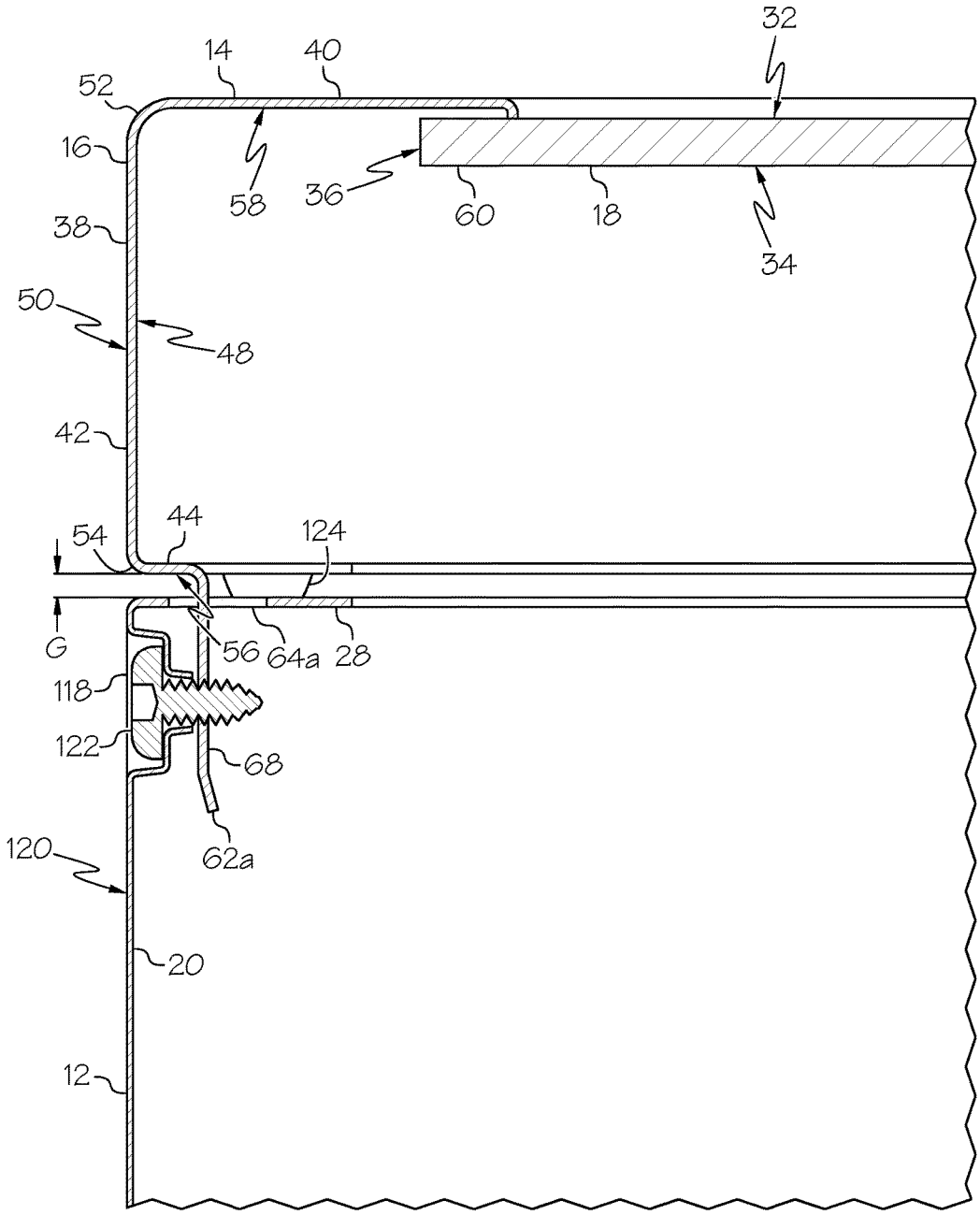
FIG. 4 is a cross-sectional view of a portion of the cooking appliance taken along line 4-4 in FIG. 2.

The hob plate 18 of the hob 14 can be a glass ceramic plate or other type of plate that provides a cooking surface for the cooking appliance 10. As shown in FIG. 4, the hob plate 18 can include a top surface 32 (which can serve as the cooking surface), a bottom surface 34 and an edge surface 36 that is transverse to and intersects the top surface 32 and the bottom surface 34. Electric heating elements can be provided to the hob 14, underneath the hob plate 18 to heat portions of the top surface 32 for radiant cooking or to apply a magnetic field for induction cooking. Alternatively, the hob plate 18 can have cutouts for gas burners to extend therethrough for cooking with a flame.

The frame 16 of the hob 14 is designed to support the hob plate 18. The frame 16 can either be a component that is integral with the hob plate 18 or the frame 16 can be a separate component that is coupled to the hob plate 18. For instance, in some embodiments, the hob plate 18 and the frame 16 can be an integrated structure that is made from a single sheet of metal that is cut and bent to form the hob 14. For example, this may be the case in examples wherein the hob 14 is a gas hob. In other embodiments, the frame 16 and the hob plate 18 may be separate components that are coupled to each other. For example, this may be the case in examples wherein the hob 14 is an electric hob and the hob plate 18 is a glass ceramic plate of the electric hob while the frame 16 is a separate component made out of metal.

In the present embodiment, the frame 16 is a separate component and has a frame body 38 for supporting the hob plate 18. The frame body 38 can include a support flange 40, a sidewall member 42, and a mounting flange 44. The sidewall member 42 includes an inner surface 48 and an outer surface 50 and is spaced outward from the hob plate 18 such that the inner surface 48 faces the edge surface 36 of the hob plate 18. The support flange 40 extends generally inward and horizontally from an upper end 52 of the sidewall member 42 and the mounting flange 44 extends generally inward and horizontally from a lower end 54 of the sidewall member 42. The mounting flange 44 includes a mounting surface 56 that faces downward and away from the bottom surface 34 of the hob plate 18. In the illustrated embodiment, the support flange 40, the sidewall member 42 and the mounting flange 44 of the frame body 38 together form a substantially U-shaped channel open inward toward the edge surface 36 of the hob plate 18. However, the frame body 38 can have a variety of different shapes and configurations in other embodiments.

The frame body 38 is adapted to at least partially surround the hob plate 18 such that the support flange 40 overlaps an edge portion of the hob plate 18. In the illustrated embodiment, the support flange 40 is configured as an inwardly extending, horizontal flange that extends from the sidewall member 42 substantially around the perimeter of the hob plate 18, thereby defining a substantially square opening through which the top surface 32 of the hob plate 18 will be exposed for use as a cooking surface when installed to the appliance. For example, as shown in FIG. 4, the support flange 40 can be arranged such that a lower surface 58 of the support flange 40 overlaps an edge portion 60 of the hob plate 18 and faces the top surface 32 of the hob plate 18. The hob plate 18 can then be secured to the frame body 38 using, for example, adhesive applied between the support flange 40 and the edge portion 60. In other examples, the support flange 40 can be arranged such that an upper surface of the support flange 40 overlaps the edge portion 60 of the hob plate 18 and faces the bottom surface 34 of the hob plate 18. In such examples, the edge portion 60 can rest on the support flange 40 and could also be secured to the frame body 38 using, for example, adhesive applied between the support flange 40 and the edge portion 60.

Figure 5:
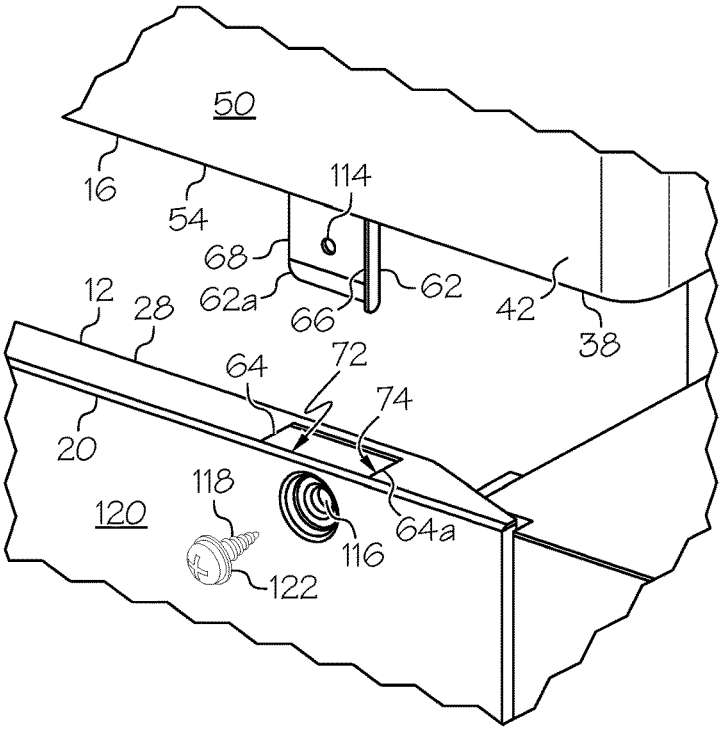
FIG. 5 is a close-up perspective view of the cooking appliance with the hob separated from the chassis and showing a location where they can be attached, as viewed from an exterior of the cooking appliance.
Figure 6:
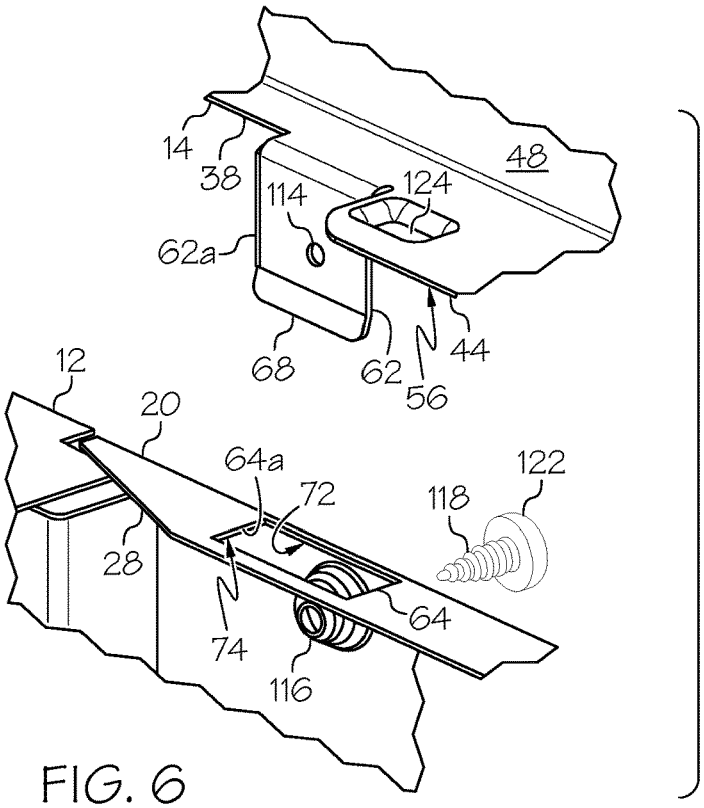
FIG. 6 is a close-up view of the cooking appliance showing the location shown in FIG. 5 but from a different perspective as viewed from an interior of the cooking appliance.

As shown in FIG. 1 and more closely in FIGS. 5 & 6, the frame 16 can have one or more mounting tongues 62 depending from the frame body 38 for connecting the frame 16 to the chassis 12 of the cooking appliance 10. The mounting tongues 62 are preferably integrally formed with the frame body 38 and can extend downward from, for example, an underside of the frame body 38 (e.g., mounting surface 56). Moreover, the mounting portions 28 of the chassis 12 can include apertures 64 corresponding to and aligned with respective mounting tongues 62 in order to receive therein the mounting tongues 62 upon installation of the hob 14 to the chassis 12. By making the mounting tongues 62 integral with the frame body 38, installation of the frame 16 to the chassis 12 can be simplified because the mounting tongues 62 or other bracketing or securing structure will not need to be separately attached to both the support frame 16 and chassis 12. Rather, the integrated mounting tongues 62 can be inserted into the cooperating apertures 64 and fixed to the chassis 12 with, for example, fasteners to complete installation. Moreover, in some examples, the mounting tongues 62 can be inserted into the apertures 64 to complete installation without the need of additional fasteners.

The mounting tongues 62 and apertures 64 can each be configured such that insertion of the mounting tongues 62 within the apertures 64 will limit side-to-side, front-to-back, and/or diagonal movement of the frame 16 relative to the chassis 12. For example, as shown in FIGS. 7-10, the frame 16 can include first, second, third, and fourth mounting tongues 62*a*, 62*b*, 62*c*, 62*d* that extend downward into respective first, second, third, and fourth apertures 64*a*, 64*b*, 64*c*, 64*d* that are aligned with the tongues and configured and dimensioned to limit side-to-side and front-to-back movement of the frame 16 relative to the chassis 12.

Figure 7:
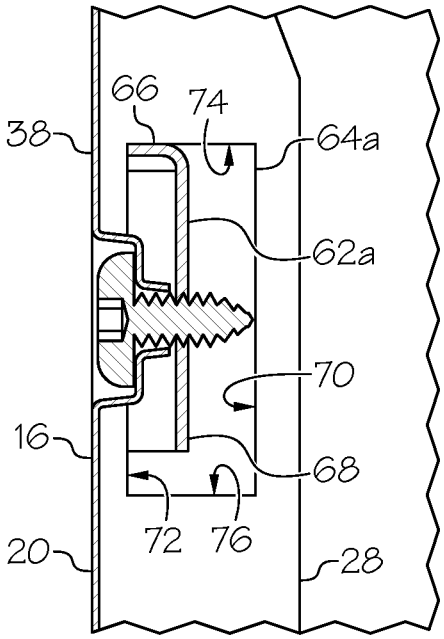
FIG. 7 is a cross-sectional view of the cooking appliance taken along line 7-7 in FIG. 2.

More specifically, as shown in FIG. 7, the first mounting tongue 62*a* extends downward from a front-left side of the frame 16 into the first aperture 64*a* in the mounting portion 28 of the left side panel 20. The first mounting tongue 62*a* can include a first member 66 and a second member 68 that are transverse to each other. The first and second members 66, 68 can be substantially perpendicular to each other such that the first mounting tongue 62*a* has an L-shaped configuration when viewed in horizontal cross-section. Moreover, the first aperture 64*a* can have right and left edge surfaces 70, 72 that extend in a first direction (e.g., a front-to-back direction) and front and back edge surfaces 74, 76 that extend in a second direction (e.g., a side-to-side direction) that is traverse to (e.g., perpendicular to) the first direction. In the illustrated embodiment, the right edge surface 70 faces the left side panel 20 of the cooking appliance 10, the left edge surface 72 faces the right side panel 22 of the cooking appliance 10, the front edge surface 74 faces away from the front panel 24 of the cooking appliance 10, and the back edge surface 76 faces toward the front panel 24. Together, the right and left edge surfaces 70, 72 and front and back edge surfaces 74, 76 define a substantially rectangular space open to and substantially in register with the first aperture 64*a*, so that the tongue 62*a* inserted through that aperture 64*a* will be received and bounded within the space defined between the aforementioned edge surfaces.

Figure 8:
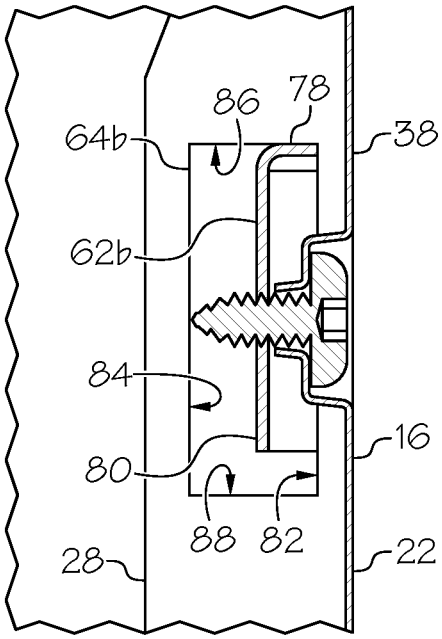
FIG. 8 is a cross-sectional view of the cooking appliance taken along line 8-8 in FIG. 2.

As shown in FIG. 8, the second mounting tongue 62*b* extends downward from a front-right side of the frame 16 into the second aperture 64*b* in the mounting portion 28 of the right side panel 22. The second mounting tongue 62*b* can include a first member 78 and a second member 80 that are transverse to each other. The first and second members 78, 80 can be substantially perpendicular to each other such that the second mounting tongue 62*b* has an L-shaped configuration when viewed in horizontal cross-section. Moreover, the second aperture 64*b* can have right and left edge surfaces 82, 84 that extend in a first direction (e.g., a front-to-back direction) and front and back edge surfaces 86, 88 that extend in a second direction (e.g., a side-to-side direction) that is traverse to (e.g., perpendicular to) the first direction. In the illustrated embodiment, the right edge surface 82 faces the left side panel 20 of the cooking appliance 10, the left edge surface 84 faces the right side panel 22 of the cooking appliance 10, the front edge surface 86 faces away from the front panel 24 of the cooking appliance 10, and the back edge surface 88 faces toward the front panel 24. Together, the right and left edge surfaces 82, 84 and front and back edge surfaces 86, 88 define a substantially rectangular space open to and substantially in register with the second aperture 64*b*, so that the tongue 62*b* inserted through that aperture 64*b* will be received and bounded within the space defined between the aforementioned edge surfaces.

Figure 9:
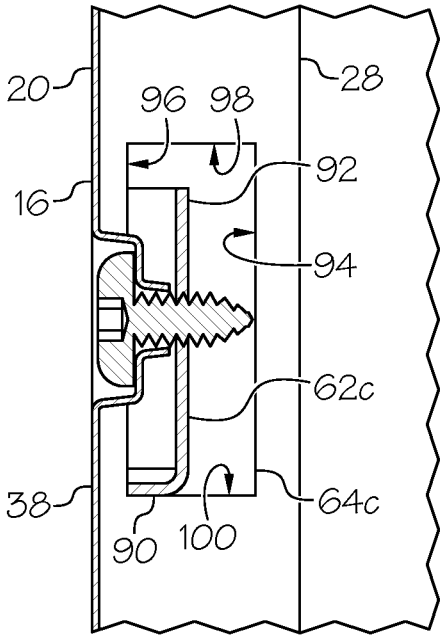
FIG. 9 is a cross-sectional view of the cooking appliance taken along line 9-9 in FIG. 3.

As shown in FIG. 9, the third mounting tongue 62*c* extends downward from a left-rear side of the frame 16 into the third aperture 64*c* in the mounting portion 28 of the left side panel 20. The third mounting tongue 62*c* can include a first member 90 and a second member 92 that are transverse to each other. The first and second members 90, 92 can be substantially perpendicular to each other such that the third mounting tongue 62*c* has an L-shaped configuration when viewed in horizontal cross-section. Moreover, the third aperture 64*c* can comprise right and left edge surfaces 94, 96 that extend in a first direction (e.g., a front-to-back direction) and front and back edge surfaces 98, 100 that extend in a second direction (e.g., a side-to-side direction) that is traverse to (e.g., perpendicular to) the first direction. In the illustrated embodiment, the right edge surface 94 faces the left side panel 20 of the cooking appliance 10, the left edge surface 96 faces the right side panel 22 of the cooking appliance 10, the front edge surface 98 faces away from the front panel 24 of the cooking appliance 10, and the back edge surface 100 faces toward the front panel 24. Together, the right and left edge surfaces 94, 96 and front and back edge surfaces 98, 100 define a substantially rectangular space open to and substantially in register with the third aperture 64*c*, so that the tongue 62*c* inserted through that aperture 64*c* will be received and bounded within the space defined between the aforementioned edge surfaces.

Figure 10:
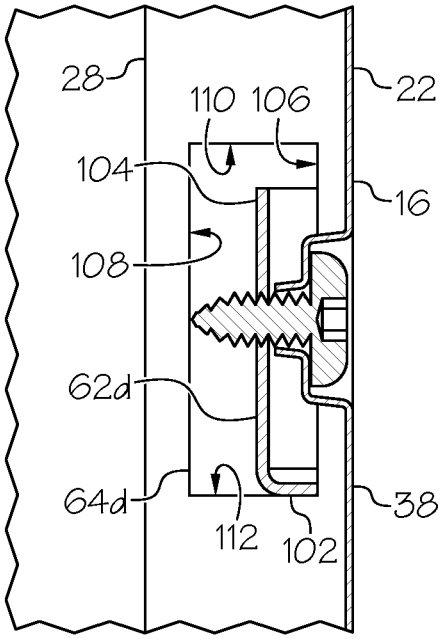
FIG. 10 is a cross-sectional view of the cooking appliance taken along line 10-10 in FIG. 3.

As shown in FIG. 10, the fourth mounting tongue 62*d* extends downward from a right-rear side of the frame 16 into the fourth aperture 64*d* in the mounting portion 28 of the left side panel 20. The fourth mounting tongue 62*d* can include a first member 102 and a second member 104 that are transverse to each other. The first and second members 102, 104 can be substantially perpendicular to each other such that the fourth mounting tongue 62*d* has an L-shaped configuration when viewed in horizontal cross-section. Moreover, the fourth aperture 64*d* can comprise right and left edge surfaces 106, 108 that extend in a first direction (e.g., a front-to-back direction) and front and back edge surfaces 110, 112 that extend in a second direction (e.g., a side-to-side direction) that is traverse to (e.g., perpendicular to) the first direction. In the illustrated embodiment, the right edge surface 106 faces the left side panel 20 of the cooking appliance 10, the left edge surface 108 faces the right side panel 22 of the cooking appliance 10, the front edge surface 110 faces away from the front panel 24 of the cooking appliance 10, and the back edge surface 112 faces toward the front panel 24. Together, the right and left edge surfaces 106, 108 and front and back edge surfaces 110, 112 define a substantially rectangular space open to and substantially in register with the fourth aperture 64*d*, so that the tongue 62*d* inserted through that aperture 64*d* will be received and bounded within the space defined between the aforementioned edge surfaces.

The mounting tongues 62*a*, 62*b*, 62*c*, 62*d* are designed such that insertion thereof into the respective apertures 64*a*, 64*b*, 64*c*, 64*d* will limit side-to-side, front-to-back, and diagonal movement of the frame 16 relative to the chassis 12. More specifically, each tongue 62 when received through the associated aperture 64 is bounded by the surrounding edge surfaces registered with the aperture 64 so that lateral or transverse movement of the frame 16 relative to the chassis will result in the tongue 62 approaching and ultimately abutting one or more of those surfaces. As a result, lateral or transverse movement of the frame 16 is bounded with respect to each tongue 62 by the available area for that tongue to move in the space defined between the associated edge surfaces.

Moreover, the respective tongues 62*a*, 62*b*, 62*c* and 62*d* can be positioned and dimensioned so that they cooperate together to inhibit substantially any lateral or transverse movement of the frame 16 once installed to the chassis 12 through the corresponding apertures 64*a*, 64*b*, 64*c* and 64*d* therein. For example, in the present embodiment and looking at FIGS. 7-10 together, one can see that on account of the locations and configurations (in this case respective L-shaped cross sections) of the four tongues, they cooperate to inhibit side-to-side, front-to-rear, and diagonal movement of the frame 16 once installed to the chassis 12. Specifically, tongues on one side of the frame 16 will engage edge surfaces facing one direction and tongues on an opposite side of the frame 16 will engage edge surfaces facing an opposite direction to inhibit lateral or transverse movement of the frame 16 relative to the chassis 12. For example, the first mounting tongue 62*a* on the left side of the frame 16 will engage the left edge surface 72 of the first aperture 64*a* and the second mounting tongue 62*b* on the right side of the frame 16 will engage the right edge surface 82 of the second aperture 64*b* to limit side-to-side movement of the frame 16 relative to the chassis 12. Likewise, the third mounting tongue 62*c* on the left side of the frame 16 will engage the left edge surface 96 of the third aperture 64*c* and the fourth mounting tongue 62*d* on the right side of the frame 16 will engage the right edge surface 106 of the fourth aperture 64*d* to also limit side-to-side movement of the frame 16 relative to the chassis 12. Together, the four tongues inhibit side-to-side movement of the frame 16 relative to the chassis, both at the front and the rear of the appliance.

Front-to-rear movement is also inhibited. Specifically, the first mounting tongue 62*a* on the front side of the frame 16 will engage the front edge surface 74 of the first aperture 64*a* and the third mounting tongue 62*c* on the rear side of the frame 16 will engage the back edge surface 100 of the third aperture 64*c* to limit front-to-back movement of the frame 16 relative to the chassis 12. Likewise, the second mounting tongue 62*b* on the front side of the frame 16 will engage the front edge surface 86 of the second aperture 64*b* and the fourth mounting tongue 62*d* on the rear side of the frame 16 will engage the back edge surface 112 of the fourth aperture 64*d* to limit front-to-back movement of the frame 16 relative to the chassis 12.

Diagonal movement is also inhibited. For example, by simultaneously inhibiting both side-to-side and front-to-rear movement as described above, diagonal movement will also be inhibited. Moreover, the engagement of tongues in cross-corners of the frame 16 with edge surfaces facing opposite directions will further inhibit diagonal movement. For instance, in the present example, the first mounting tongue 62*a* in the front-left corner of the frame 16 will engage edge surfaces 72, 74 of the first aperture 64*a* and the fourth mounting tongue 62*d* in the rear-right corner of the frame 16 will engage edge surfaces 102, 106 of the fourth aperture 64*d* to limit diagonal movement of the frame 16 relative to the chassis 12 between the front-left and rear-right corners. Likewise, the second mounting tongue 62*b* in the front-right corner of the frame 16 will engage edge surfaces 78, 82 of the second aperture 64*b* and the third mounting tongue 62*c* in the rear-left corner of the frame 16 will engage edge surfaces 90, 96 of the third aperture 64*c* to limit diagonal movement of the frame 16 relative to the chassis 12 between the front-right and rear-left corners.

It should be appreciated that the mounting tongues 62 can engage different opposing edge surfaces in other embodiments to limit movement of the frame 16 relative to the chassis 12. For example, in some embodiments, the first mounting tongue 62*a* on the left side of the frame 16 can engage the right edge surface 70 of the first aperture 64*a* and the second mounting tongue 62*c* on the right side of the frame 16 can engage the left edge surface 84 of the second aperture 64*b* to limit side-to-side movement of the frame 16 relative to the chassis 12. The mounting tongues 62 can be configured to engage any sets of oppositely facing edge surfaces to limit lateral or transverse movement of the frame 16 relative to the chassis 12.

In the illustrated embodiment the apertures 64*a*, 64*b*, 64*c*, 64*d* all have a generally rectangular shape having greater lateral dimensions than the associated mounting tongue to facilitate easy insertion of the tongues 62*a*, 62*b*, 62*c*, 62*d* into the apertures 64*a*, 64*b*, 64*c*, 64*d*, though other shapes and sizes are possible in other embodiments. Moreover, the L-shaped configuration of the mounting tongues 62*a*, 62*b*, 62*c*, 62*d* imparts strength and structural rigidity to them, thereby further adding to the rigidity of the frame body 38 from which they depend, and ultimately to the frame 16. However, it should be appreciated that the mounting tongues 62*a*, 62*b*, 62*c*, 62*d* may have other bended configurations to impart strength and structural rigidity to them. For instance, the tongues 62 may have a U-shaped configuration or some other bended geometry.

As configured above, insertion of the mounting tongues 62*a*, 62*b*, 62*c*, 62*d* into the apertures 64*a*, 64*b*, 64*c*, 64*d* will provide a firm coupling of the frame 16 to the chassis 12 that limits side-to-side movement, front-to-back movement, and diagonal movement of the frame 16 (and thereby the hob 14) relative to the chassis 12. Moreover, when the mounting tongues 62*a*, 62*b*, 62*c*, 62*d* are inserted into the apertures 64*a*, 64*b*, 64*c*, 64*d*, the frame 16 will be properly squared to the chassis 12 within a fine tolerance thus inhibiting rotation of the hob 14 relative to the chassis 12, contributing to overall fit and finish of the appliance 10. Furthermore, in preferred embodiments the frame 16 and hob plate 18 are glued or integrated together to form the hob 14, resulting in a very stiff assembly. Accordingly, assembly of the hob 14 to the chassis 12 as herein described also will impart additional structural rigidity to the side panels 20, 22 of the chassis 12 due to the stiffness of the hob 14, which when installed will be rigidly connected to the chassis 12 at the respective side panels 20, 22 thereof, thus inhibiting torsion or other displacement of the side panels 20, 22.

Due to the firm coupling of the tongues 62 within the apertures 64, installation of the hob 14 to the chassis 12 may be completed simply by placing the hob plate 18 together with its surrounding frame 16 over the appliance chassis 12, and lowering the same until the mounting tongues 62 depending from the frame body 38 are inserted through the apertures 64. As such, the need for separate mounting brackets or other mounting structure is eliminated, thereby simplifying installation. Moreover, separate mounting structure can introduce tolerances and deviations in the appliance 10 that can weaken the coupling between the frame 16 and chassis 12. As such, the integrated tongue structure described above reduces the tolerance chain by eliminating the need for separate mounting structure, thereby providing a stronger coupling between the frame 16 and chassis 12.

Although installation of the frame 16 to the chassis 12 can be completed upon insertion of the tongues 62 within the apertures 64 without the need for further fasteners, it may still be desirable in some examples to use one or more fasteners to fix the mounting tongues 62 to the chassis 12 after they are inserted within the apertures 64. For instance, one or more of the mounting tongues 62 can be fastened to the chassis 12 using threaded fasteners, rivets, welds, clips, hooks, adhesive, or some other fastening element. For example, as shown in FIGS. 4-7 the mounting tongue 62*a* can include a hole 114 that extends through the second member 68 of the mounting tongue 62*a*. The hole 114 will align with a corresponding hole 116 in the left side panel 20 of the chassis 12 when the mounting tongue 62*a* is inserted through its associated aperture 64*a*. A fastener 118, e.g. a threaded fastener such as a bolt or screw, can then be inserted through the holes 114, 116 and be threaded therewith to fix the frame 16 to the chassis 12. If desired, a nut can be threaded onto the terminal end of the fastener 118 after it has been inserted through holes 114 and 116 to secure the fastener in place. However, this may be less preferred than simply threading the fastener 118 to one or both of the holes 114, 116 because the latter can be accomplished quickly and easily from outside the chassis 12 after it has been assembled with the hob 14; whereas threading a nut as described above may require access to an interior space of the chassis after the hob 14 has been installed, which may involve additional manufacturing complexity. The remaining mounting tongues 62 can be similarly fastened to the chassis 12.

In some embodiments, the outer surface 50 of the frame body 38 can be flush with an outer surface 120 of the left side panel 20 when the frame 16 is mounted to the chassis 12, as shown in FIG. 4. Moreover, the head 122 of a threaded fastener 118 can also be flush with the outer surfaces 50, 120 of the frame body 38 and left side panel 20. This can provide an aesthetically pleasing look for the cooking appliance 10. To permit such a construction, the second member 68 of the mounting tongue 62*a* can be horizontally inset from the outer surface 50 of the frame body 38. This inset of the second member 68 can allow the hole 114 in the left side panel 20 to be countersunk, thereby allowing the head 122 of the threaded fastener 118 to be flush with the outer surfaces 50, 120 of the frame body 38 and left side panel 20. The remaining mounting tongues 62 can be similarly inset from the outer surface 50 of the frame body 38 to permit a flush construction of the frame body 38 with the left and right side panels 20, 22 of the chassis 12.

In some embodiments, the mounting surface 56 of the frame body 38 will abut and be flush with mounting portions 28 of the left and right side panels 20, 22. However, in some embodiments, a slight gap may be present between the mounting surface 56 and the left and right side panels 20, 22 to provide an aesthetically pleasing design. To provide such a gap, the frame 16 can include one or more embossments 124 that depend from the frame body 38 and extend from, for example, an underside of the frame body 38 (e.g., mounting surface 56) for spacing the frame body 38 from the chassis 12 when the frame 16 is connected to the chassis 12, as shown in FIGS. 4 & 6. The embossments 124 are preferably integrally formed in the frame body 38 by, for example, stamping the mounting flange 44 or some other portion of the frame body 38 to produce the embossments 124. When the frame 16 is mounted to the chassis 12, the embossments 124 will rest on the mounting portions 28 of the side panels 20, 22 and a gap G will be present between the mounting surface 56 and the mounting portions 28 of the side panels 20, 22.

The invention has been described with reference to example embodiments described above. Modifications and alterations will occur to others upon a reading and understanding of this specification. Example embodiments incorporating one or more aspects described above are intended to include all such modifications and alterations insofar as they come within the scope of the appended claims.

What is claimed is:

1. A cooking hob comprising:

a hob plate;

one or more heating elements; and a frame supporting the hob plate, the frame comprising:

a frame body, and at least one mounting tongue depending from the frame body and extending from an underside thereof for connecting the frame to a chassis of a cooking appliance, wherein the at least one mounting tongue comprises a cross-section that is L-shaped, the cross section being taken along a horizontal plane parallel to the hob plate.

2. The cooking hob of claim 1, said mounting tongue being formed integrally with the frame body.

3. The cooking hob of claim 2, wherein the frame body at least partially surrounds the hob plate.

4. The cooking hob according to claim 3, wherein the at least one mounting tongue is inset horizontally from an outer surface of the frame body.

5. The cooking hob according to claim 1, wherein the at least one mounting tongue comprises first and second mounting tongues arranged on said frame body so as to align with and be received through corresponding first and second apertures of the chassis when said frame body is lowered onto said chassis from above.

6. The cooking hob of claim 5, each of said first and second apertures having associated therewith a plurality of edge surface portions defining respective first and second spaces therebetween, wherein said first mounting tongue will be bounded within said first space thereby constraining lateral or transverse movement thereof upon insertion through said first aperture, and said second mounting tongue will be bounded within said second space thereby constraining lateral or transverse movement thereof upon insertion through said second aperture.

7. The cooking hob of claim 6, wherein said first and second mounting tongues engage against respective edge surface portions associated respectively with said first and second apertures so as to cooperatively inhibit at least one of front-to-back lateral movement and side-to-side lateral movement of the first and second mounting tongues.

8. The cooking hob of claim 6, wherein said frame will be substantially constrained against lateral or transverse movement relative to said chassis when assembled thereto via cooperative action of at least said first and second mounting tongues being engaged against respective edge surface portions associated with at least the respective first and second apertures.

9. The frame according to claim 1, wherein the at least one mounting tongue comprises a hole extending therethrough configured to accommodate a fastener.

10. The cooking hob according to claim 1, wherein the at least one mounting tongue is integral with the frame body and the cross-section is monolithic.

11. A cooking hob comprising:

a hob plate;

a plurality of heating elements; and a frame supporting the hob plate, the frame comprising:

a frame body, and an embossment depending from the frame body and extending from an underside of the frame body for spacing the frame body from a chassis of a cooking appliance when the frame body is connected to the chassis, wherein the embossment of the frame is configured to rest on the chassis to space the frame body from the chassis.

12. The cooking hob according to claim 11, further comprising at least one mounting tongue depending from the frame body and extending from an underside of the frame body for connecting the frame body to the chassis of the cooking appliance.

13. The cooking hob according to claim 12, wherein the at least one mounting tongue comprises a cross-section that is L-shaped, the cross section being taken along a horizontal plane parallel to the hob plate.

14. A cooking appliance comprising:

a chassis; and a hob comprising a hob plate, one or more heating elements, and a frame mounted to the chassis and supporting the hob plate, the frame comprising:

a frame body, and at least one mounting tongue depending from the frame body and extending from an underside of the frame body, the at least one mounting tongue connecting the frame body to the chassis, wherein the at least one mounting tongue extends through an aperture of the chassis and engages first and second edge surface portions of the aperture so as to inhibit movement of the frame relative to the chassis in a first horizontal direction and a second horizontal direction that is perpendicular to the first horizontal direction.

15. The cooking appliance according to claim 14, wherein the at least one mounting tongue comprises first and second mounting tongues arranged on said frame body that are aligned with and received through corresponding first and second apertures of the chassis.

16. The cooking appliance according to claim 15, each of said first and second apertures having associated therewith a plurality of edge surface portions defining respective first and second spaces therebetween, wherein said first mounting tongue and said second mounting tongue are respectively bounded within said first space and said second space, thereby constraining lateral or transverse movement thereof.

17. The cooking appliance according to claim 15, wherein said first and second mounting tongues engage against respective edge surface portions associated respectively with said first and second apertures so as to cooperatively inhibit at least one of front-to-back lateral movement and side-to-side lateral movement of the frame relative to the chassis.

18. The cooking appliance of claim 15, wherein a first tongue on one side of the frame engages an edge surface portion facing one direction and a second tongue on an opposite side of the frame engages another edge surface portion facing an opposite direction to inhibit lateral or transverse movement of the frame relative to the chassis.

19. The cooking appliance according to claim 14, wherein the at least one mounting tongue comprises a cross-section that is L-shaped, the cross-section being taken along a horizontal plane parallel to the hob plate.

20. The cooking appliance according to claim 14, wherein the at least one mounting tongue is inset horizontally from an outer surface of the frame body.

21. The cooking appliance according to claim 14, wherein the at least one mounting tongue comprises a hole extending therethrough that accommodates a fastener.

22. The cooking appliance according to claim 14, wherein the frame further comprises an embossment depending from the frame body and extending from an underside of the frame body that spaces the frame body from the chassis.

23. The cooking appliance according to claim 22, wherein the frame is mounted to the chassis such that the embossment rests on a mounting portion of the chassis and a gap is present between the mounting portion of the chassis and a mounting surface of the frame body.

24. The cooking appliance according to claim 14, wherein the hob plate is glued to the frame to provide a rigid assembly such that connection of the frame body to the chassis imparts structural rigidity to side panels of the chassis that inhibits torsion or other displacement of the side panels.

25. The cooking appliance according to claim 22, wherein the embossment of the frame rests on the chassis to space the frame body from the chassis.

26. The cooking appliance according to claim 14, wherein the aperture of the chassis is a planar opening.

27. The cooking appliance according to claim 14, wherein the at least one mounting tongue comprises:

a front-left mounting tongue on said frame body that is aligned with and received through a front-left aperture of the chassis, the front-left mounting tongue engaging a front edge surface portion and a left edge surface portion of the front-left aperture, a front-right mounting tongue on said frame body that is aligned with and received through a front-right aperture of the chassis, the front-right mounting tongue engaging a front edge surface portion and a right edge surface portion of the front-right aperture, a rear-left mounting tongue on said frame body that is aligned with and received through a rear-left aperture of the chassis, the rear-left mounting tongue engaging a rear edge surface portion and a left edge surface portion of the rear-left aperture, and a rear-right mounting tongue on said frame body that is aligned with and received through a rear-right aperture of the chassis, the rear-right mounting tongue engaging a rear edge surface portion and a right edge surface portion of the rear-right aperture.

* * * * *